US010364617B2

(12) United States Patent
Kirkhope

(10) Patent No.: US 10,364,617 B2
(45) Date of Patent: Jul. 30, 2019

(54) SLIP RING WITH A TENSIONED CONTACT ELEMENT

(71) Applicant: Halliburton Energy Services, Inc., Houston, TX (US)

(72) Inventor: Kennedy J. Kirkhope, Nisku (CA)

(73) Assignee: Halliburton Energy Services, Inc., Houston, TX (US)

( * ) Notice: Subject to any disclaimer, the term of this patent is extended or adjusted under 35 U.S.C. 154(b) by 154 days.

(21) Appl. No.: 15/125,792

(22) PCT Filed: Apr. 15, 2014

(86) PCT No.: PCT/CA2014/000348
§ 371 (c)(1),
(2) Date: Sep. 13, 2016

(87) PCT Pub. No.: WO2015/157837
PCT Pub. Date: Oct. 22, 2015

(65) Prior Publication Data

US 2017/0002613 A1 Jan. 5, 2017

(51) Int. Cl.

| | |
|---|---|
| ***E21B 17/02*** | (2006.01) |
| ***E21B 7/06*** | (2006.01) |
| ***H01R 39/64*** | (2006.01) |
| ***H01R 39/08*** | (2006.01) |
| ***H01R 43/10*** | (2006.01) |

(52) U.S. Cl.
CPC ..... *E21B 17/028* (2013.01); *E21B 7/062* (2013.01); *H01R 39/08* (2013.01); *H01R 39/64* (2013.01); *H01R 43/10* (2013.01)

(58) Field of Classification Search
CPC ..... E21B 17/028; H01R 39/08; H01R 43/10
USPC ..... 166/65.1
See application file for complete search history.

(56) References Cited

U.S. PATENT DOCUMENTS

| | | | | |
|---|---|---|---|---|
| 4,296,345 | A | 10/1981 | Haberl | |
| 4,447,752 | A | 5/1984 | Boyce et al. | |
| 4,537,457 | A * | 8/1985 | Davis, Jr. | E21B 17/028 439/190 |
| 5,829,148 | A | 11/1998 | Eaton | |
| 5,977,681 | A | 11/1999 | Retzlaff | |
| 6,244,361 | B1 | 6/2001 | Comeau et al. | |

(Continued)

FOREIGN PATENT DOCUMENTS

| | | | |
|---|---|---|---|
| CN | 201226409 | Y | 4/2009 |
| CN | 101902006 | A | 12/2010 |

(Continued)

*Primary Examiner* — Taras P Bemko
(74) *Attorney, Agent, or Firm* — Terrence N. Kuharchuk; Parlee McLaws LLP; Craig W. Roddy

(57) ABSTRACT

One example embodiment is an apparatus including a ring assembly and a contact assembly. The ring assembly includes a conductive ring having a conductive ring engagement surface. The contact assembly includes a contact block and a contact element having a contact element engagement surface. The contact element is connected with the contact block. The contact element forms a loop around the conductive ring between the ends of the contact element. The contact element engagement surface is engaged with the conductive ring engagement surface along an electrical contact section of the loop. Another example embodiment is a method for assembling a slip ring.

26 Claims, 4 Drawing Sheets

(56) References Cited

U.S. PATENT DOCUMENTS

| | | | |
|---|---|---|---|
| 6,769,499 | B2 | 8/2004 | Cargill et al. |
| 7,019,431 | B1 | 3/2006 | Kerlin |
| 7,320,363 | B2 | 1/2008 | Sand et al. |
| 8,157,002 | B2 | 4/2012 | Clarkson et al. |
| 8,167,623 | B2 | 5/2012 | Schlichtherle et al. |
| 2009/0039728 | A1 | 2/2009 | Balsells |
| 2011/0017473 | A1 | 1/2011 | Clarkson et al. |

FOREIGN PATENT DOCUMENTS

| | | | |
|---|---|---|---|
| CN | 103401117 | A | 11/2013 |
| WO | 2011011399 | | 1/2011 |

* cited by examiner

SLIP RING WITH A TENSIONED CONTACT ELEMENT

TECHNICAL FIELD

A slip ring and a method for assembling a slip ring.

BACKGROUND OF THE INVENTION

Slip rings are commonly used in a variety of applications to transfer electrical energy, including electrical power and/or signals, over one or more channels between portions of an apparatus which experience relative rotation. As a non-limiting example, slip rings may be used in a variety of downhole applications as components of apparatus which are adapted to be inserted within boreholes. Such apparatus may include without limitation, borehole drilling apparatus, wellbore completion apparatus, wellbore logging apparatus, and/or wellbore production apparatus.

A challenge in the design and operation of slip rings is maintaining the electrical contact between the components of the slip ring while the slip ring is in use, due to movement and/or vibration of components of the slip ring, due to movement and/or vibration of components of the apparatus in which the slip ring is used, or due to other causes. Such other causes may relate to the environment in which the slip ring is operating.

As one example, a slip ring may be immersed in a dielectric fluid during its operation. The dielectric fluid creates the potential for a "hydroplaning effect" in which the dielectric fluid may cause the components of the slip ring to lose contact as they rotate relative to each other. The potential hydroplaning effect tends to increase with the viscosity of the dielectric fluid and with the relative speed of rotation between the components of the slip ring. An increased viscosity of the dielectric fluid is a risk factor for "viscous hydroplaning." An increased relative speed of rotation is a risk factor for "dynamic hydroplaning."

BRIEF DESCRIPTION OF DRAWINGS

Embodiments of the invention will now be described with reference to the accompanying drawings, in which.

DETAILED DESCRIPTION

Figure 1:
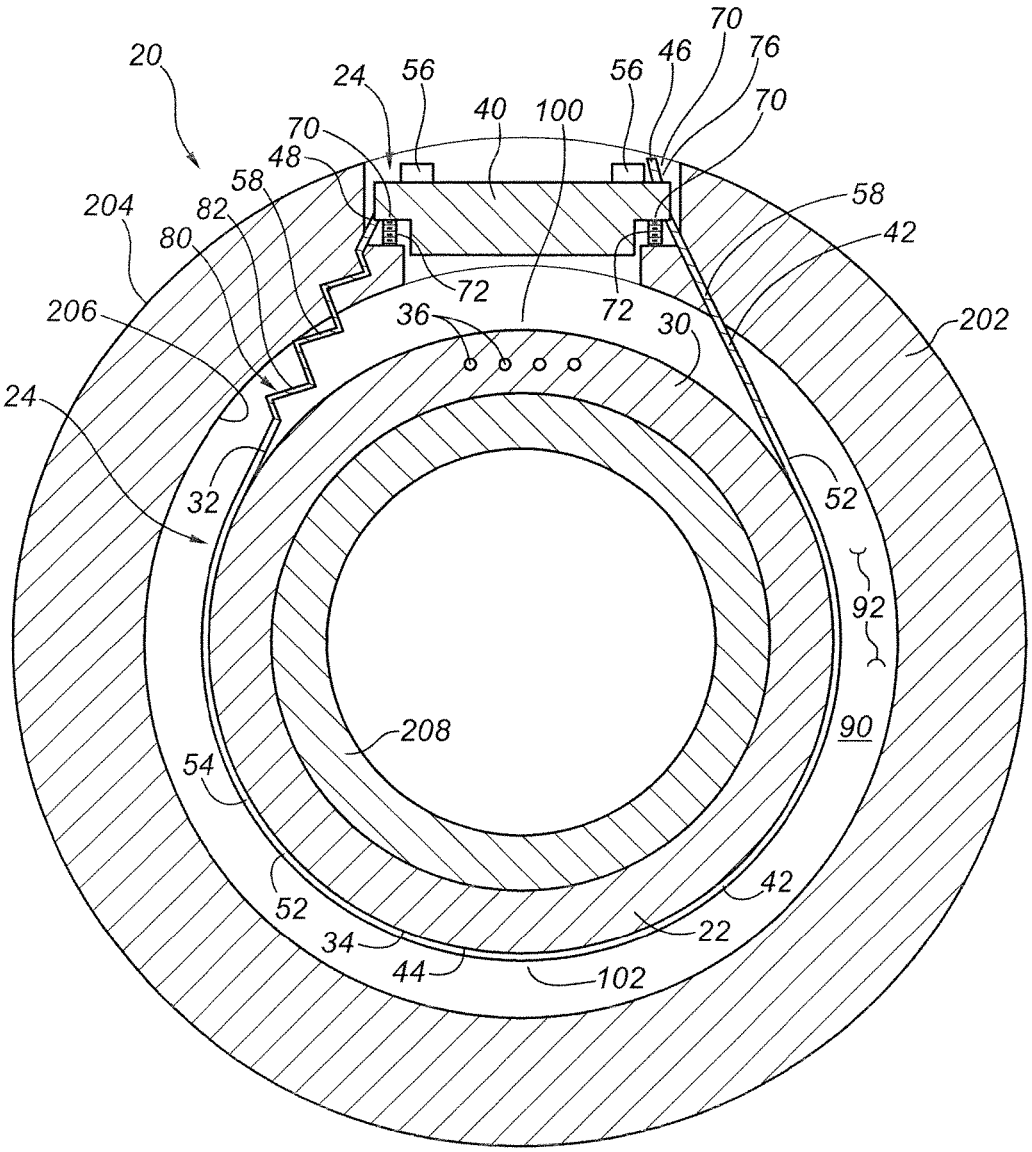
FIG. 1 is a schematic end view of a first exemplary embodiment of a slip ring.

References in this document to orientations, to operating parameters, to ranges, to lower limits of ranges, and to upper limits of ranges are not intended to provide strict boundaries for the scope of the disclosure, but should be construed to mean "approximately" or "about" or "substantially", within the scope of the teachings of this document, unless expressly stated otherwise.

The present disclosure is directed at a slip ring, at a variety of apparatus comprising the slip ring, and at a method for assembling a slip ring.

The slip ring may be used in any apparatus in which it is desired to transfer electrical energy, including electrical power and/or signals, over one or more channels between portions of the apparatus which experience relative rotation.

In some embodiments, the apparatus in which the slip ring is used may be configured to be inserted within a borehole. In some embodiments, the apparatus in which the slip ring is used may be inserted within a borehole using drill pipe, casing, tubing, coiled tubing, wireline, slickline, or in any other suitable manner.

In some embodiments, the apparatus in which the slip ring is used may be an apparatus for use in drilling a borehole. In some embodiments, the apparatus in which the slip ring is used may be a drilling motor. In some embodiments, the apparatus in which the slip ring is used may be a rotary steerable drilling apparatus.

The slip ring comprises a ring assembly and at least one contact assembly. The ring assembly and the at least one contact assembly are electrically connected with each other and are rotatable relative to each other.

Either or both of the ring assembly and the at least one contact assembly may rotate in order to provide relative rotation between the ring assembly and the at least one contact assembly. In some embodiments, the at least one contact assembly may be associated with a relatively stationary component of the apparatus and the ring assembly may be associated with a relatively rotating component of the apparatus. In some embodiments, the at least one contact assembly may be associated with a relatively rotating component of the apparatus and the ring assembly may be associated with a relatively stationary component of the apparatus.

In some embodiments, the apparatus in which the slip ring is used may comprise a housing and a shaft which rotatably extends through the interior of the housing.

In some embodiments in which the apparatus comprises a housing and a shaft, the ring assembly may be connected with the shaft so that the ring assembly rotates with the shaft. In some embodiments in which the apparatus comprises a housing and a shaft, the at least one contact assembly may be connected with the shaft so that the at least one contact assembly rotates with the shaft.

In some embodiments in which the apparatus comprises a housing and a shaft, the at least one contact assembly may be mounted within the interior of a housing which contains the ring assembly so that the ring assembly is rotatable relative to the at least one contact assembly. In some embodiments in which the apparatus comprises a housing and a shaft, the ring assembly may be mounted within the interior of a housing which contains the at least one contact assembly so that the ring assembly is rotatable relative to the at least one contact assembly.

In some embodiments, the apparatus and/or the slip ring may be further comprised of a dielectric fluid. The ring assembly and the at least one contact assembly may be immersed in the dielectric fluid. In some embodiments, the apparatus and/or the slip ring may be further comprised of a dielectric fluid chamber surrounding the ring assembly and the at least one contact assembly, for containing the dielectric fluid.

The ring assembly comprises at least one electrically conductive ring. In some embodiments, the ring assembly may comprise a plurality of conductive rings to provide redundancy and/or to facilitate a plurality of electric paths or channels.

A conductive ring has a perimeter and comprises a conductive ring engagement surface. The conductive ring engagement surface may extend completely or partially around the perimeter of a conductive ring. In some particular embodiments, a conductive ring engagement surface may extend completely around the perimeter of a conductive ring. In some particular embodiments, a conductive ring and/or a conductive ring engagement surface may be recessed relative to the ring assembly so that the conductive ring and/or the conductive ring engagement surface provides a groove in the ring assembly.

A conductive ring may be constructed of any suitable material or combination of materials. In some embodiments, a conductive ring may be constructed of a material which has a relatively low coefficient of friction. In some embodiments, a conductive ring may comprise copper and/or a beryllium copper alloy.

A contact assembly comprises at least one contact block and at least one contact element connected with the at least one contact block.

In some embodiments, the slip ring may comprise a single contact assembly. In some embodiments, the slip ring may comprise a plurality of contact assemblies.

In some embodiments, the slip ring may comprise a single contact assembly comprising a single contact element. In some embodiments, the slip ring may comprise a single contact assembly comprising a plurality of contact elements to provide redundancy and/or to facilitate a plurality of electric paths or channels. In some embodiments, the slip ring may comprise a plurality of contact assemblies comprising a single contact element or a plurality of contact elements to provide redundancy and/or to facilitate a plurality of electric paths or channels. In some embodiments, each contact element in the slip ring may have a corresponding conductive ring.

A contact element comprises a first contact element end, a second contact element end, and an electrically conductive contact element engagement surface. A contact element has a contact element length between the first contact element end and the second contact element end. In some embodiments, the contact element engagement surface may extend for the entire contact element length. In some embodiments, the contact element engagement surface may extend for only a portion of the contact element length.

A contact element may be constructed of any suitable material or combination of materials. In some embodiments, a contact element and/or a conductive ring may be constructed of a material which has a relatively low coefficient of friction so that the conductive ring is capable of rotating relative to the contact element. In some embodiments, a contact element may be entirely constructed of an electrically conductive material. In some embodiments, a contact element may be partially constructed of an electrically conductive material. In some embodiments, a contact element may be constructed of an electrically conductive material which is covered with an electrically insulating material. In some embodiments, a contact element engagement surface of a contact element may be defined by a gap or by a plurality of gaps in a covering of an electrically insulating material. In some embodiments, a contact element may comprise copper and/or a beryllium copper alloy.

A contact element forms a loop around a corresponding conductive ring between the first contact element end of the contact element and the second contact element end of the contact element. In some embodiments, the loop may extend substantially completely around the conductive ring. In some embodiments, the loop may extend partially around the conductive ring. In some embodiments, the loop may extend more than full turn around the conductive ring.

A contact element may have any shape or cross-section which is suitable for forming a loop around a conductive ring. As non-limiting examples, a contact element may have a rectangular cross-section, a circular cross-section, or an oval cross-section. In some embodiments, a contact element may have a rectangular cross-section in which a width of the contact element is much greater than a thickness of the contact element so that the contact element has a belt, strap or ribbon shape. In some embodiments, a contact element may have a circular cross-section in which the diameter is relatively small so that the contact element has a wire or cable shape.

The contact element engagement surface of a contact element is engaged with the conductive ring engagement surface of a corresponding conductive ring along an electrical contact section of the loop. In some embodiments, the electrical contact section may define an electrical contact side of the conductive ring if the electrical contact section does not extend completely around the conductive ring. In some embodiments, the electrical contact section may generally surround the conductive ring if the loop and the electrical contact section extend at least one full turn around the conductive ring.

A contact element may be connected with a contact block in any suitable manner. A contact element may be connected with a contact block to provide a mechanical connection and/or an electrical connection between the contact element and the contact block. In some embodiments, the first contact element end of a contact element may be connected with a contact block. In some embodiments, the second contact element end of a contact element may be connected with a contact block. In some embodiments, both the first contact element end and the second contact element end of a contact element may be connected with a contact block.

In some embodiments in which a contact assembly comprises a plurality of contact blocks, the contact element ends of a contact element may be connected with separate contact blocks. In some embodiments in which a contact assembly comprises a plurality of contact blocks, one of the contact element ends of a contact element may be mechanically and/or electrically connected with a first contact block and the other of the contact element ends of a contact element may be mechanically and/or electrically connected with a second contact block.

In embodiments in which a contact assembly comprises a plurality of contact blocks, the contact blocks may be located at any position relative to each other and relative to the ring assembly. In some particular embodiments, a plurality of contact blocks may be located adjacent to the ring assembly. In some particular embodiments, a plurality of contact blocks may be located adjacent to each other. In some particular embodiments, a plurality of contact blocks may be distributed around a ring assembly. In some embodiments, a plurality of contact blocks may be distributed evenly around a ring assembly.

A contact element and a corresponding conductive ring may be configured relative to each other in any suitable manner. In some embodiments, a contact element and/or its contact element engagement surface may be more narrow than a corresponding conductive ring and/or its conductive ring engagement surface in order to provide clearance for the contact element as it engages with the conductive ring, and/or in order to facilitate more than one full turn of the contact element around the conductive ring.

In some embodiments, the contact block may be a single contact block, and the slip ring may comprise the single contact block, which may be located adjacent to a conductive ring on a contact block side of the conductive ring. In some such embodiments, both the first contact element end and the second contact element end of a contact element may be connected with the single contact block. In some such embodiments, if the electrical contact section does not extend fully around the conductive ring, the electrical contact side of the conductive ring may be opposite to the contact block side of the conductive ring, so that the conductive ring is interposed between the contact block and the electrical contact section. In some such embodiments, if the loop formed by the contact element and the electrical contact section extend at least one full turn around the conductive ring, the electrical contact section of the loop may generally surround the conductive ring.

In some embodiments, the contact block may be a first contact block, and the slip ring may comprise the first contact block and a second contact block, which may be located adjacent to a conductive ring and adjacent to each other on a contact block side of the conductive ring. In some such embodiments, the first contact element end of a contact element may be connected with the first contact block and the second contact element end of the contact element may be connected with the second contact block. In some such embodiments, if the electrical contact section does not extend fully around the conductive ring, the electrical contact side of the conductive ring may be opposite to the contact block side of the conductive ring, so that the conductive ring is interposed between the contact block and the electrical contact section. In some such embodiments, if the loop formed by the contact element and the electrical contact section extend at least one full turn around the conductive ring, the electrical contact section of the loop may generally surround the conductive ring.

In some embodiments, the contact block may be a first contact block, and the slip ring may comprise the first contact block and a second contact block, which may be located adjacent to a conductive ring but separated from each other about the circumference of the conductive ring. In some such embodiments, the first contact element end of a contact element may be connected with the first contact block and the second contact element end of the contact element may be connected with the second contact block. In some such embodiments, if the electrical contact section does not extend fully around the conductive ring, the electrical contact side of the conductive ring may be circumferentially between the contact blocks. In some such embodiments, if the loop formed by the contact element and the electrical contact section extend at least one full turn around the conductive ring, the electrical contact section of the loop may generally surround the conductive ring.

In some embodiments, the slip ring may comprise one or more tensioning mechanisms for tensioning a contact element against the conductive ring engagement surface of a corresponding conductive ring. A tensioning mechanism may comprise any suitable structure, device or apparatus. In some particular embodiments, a tensioning mechanism may comprise a device for adjusting a distance between one or more contact blocks and the conductive ring.

The loop formed by the contact element around the conductive ring has a loop length, which may be shorter than the contact element length. In some embodiments, a tensioning mechanism may comprise a device for adjusting the loop length of the contact element. In some embodiments in which the slip ring may comprise a plurality of contact elements, a plurality of contact blocks, and/or a plurality of contact assemblies, the slip ring may comprise a plurality of tensioning mechanisms.

In some embodiments, the slip ring may comprise one or more biasing mechanisms for urging the contact element against the conductive ring engagement surface. A biasing mechanism may comprise any suitable structure, device or apparatus. In some particular embodiments, a biasing mechanism may comprise a spring. In some particular embodiments, a spring may be integral with a contact element so that the contact element comprises the spring. In some embodiments in which the slip ring may comprise a plurality of contact elements, a plurality of contact blocks, and/or a plurality of contact assemblies, the slip ring may comprise a plurality of biasing mechanisms.

A contact element engagement surface engages a conductive ring engagement surface with an engagement force. In some embodiments, the engagement force may be provided by the one or more tensioning mechanisms and/or by the one or more biasing mechanisms.

In some embodiments, a method for assembling a slip ring may comprise extending a contact element around a conductive ring so that the contact element forms a loop around a conductive ring and so that a contact element engagement surface is engaged with the conductive ring engagement surface. In some embodiments, the loop may extend substantially completely around a conductive ring. In some embodiments, the loop may extend partially around a conductive ring. In some embodiments, the loop may extend more than one full turn around the conductive ring.

In some embodiments, the method for assembling a slip ring may comprise mechanically and/or electrically connecting the contact element with one or more contact blocks. In some embodiments, connecting the contact element with the contact block may comprise connecting a first contact element end and/or a second contact element end with a contact block. In some embodiments, connecting the contact element with the contact block may comprise connecting one of the contact element ends with a first contact block and connecting the other of the contact element ends with a second contact block. In some embodiments, the one or more contact blocks may be located adjacent to the conductive ring.

In some embodiments, the method for assembling a slip ring may comprise tensioning the contact element against the conductive ring engagement surface. In some embodiments, the method for assembling a slip ring may comprise urging the contact element against the conductive ring engagement surface. In some embodiments, the method for assembling a slip ring may comprise immersing the slip ring in a dielectric fluid.

Figure 2:
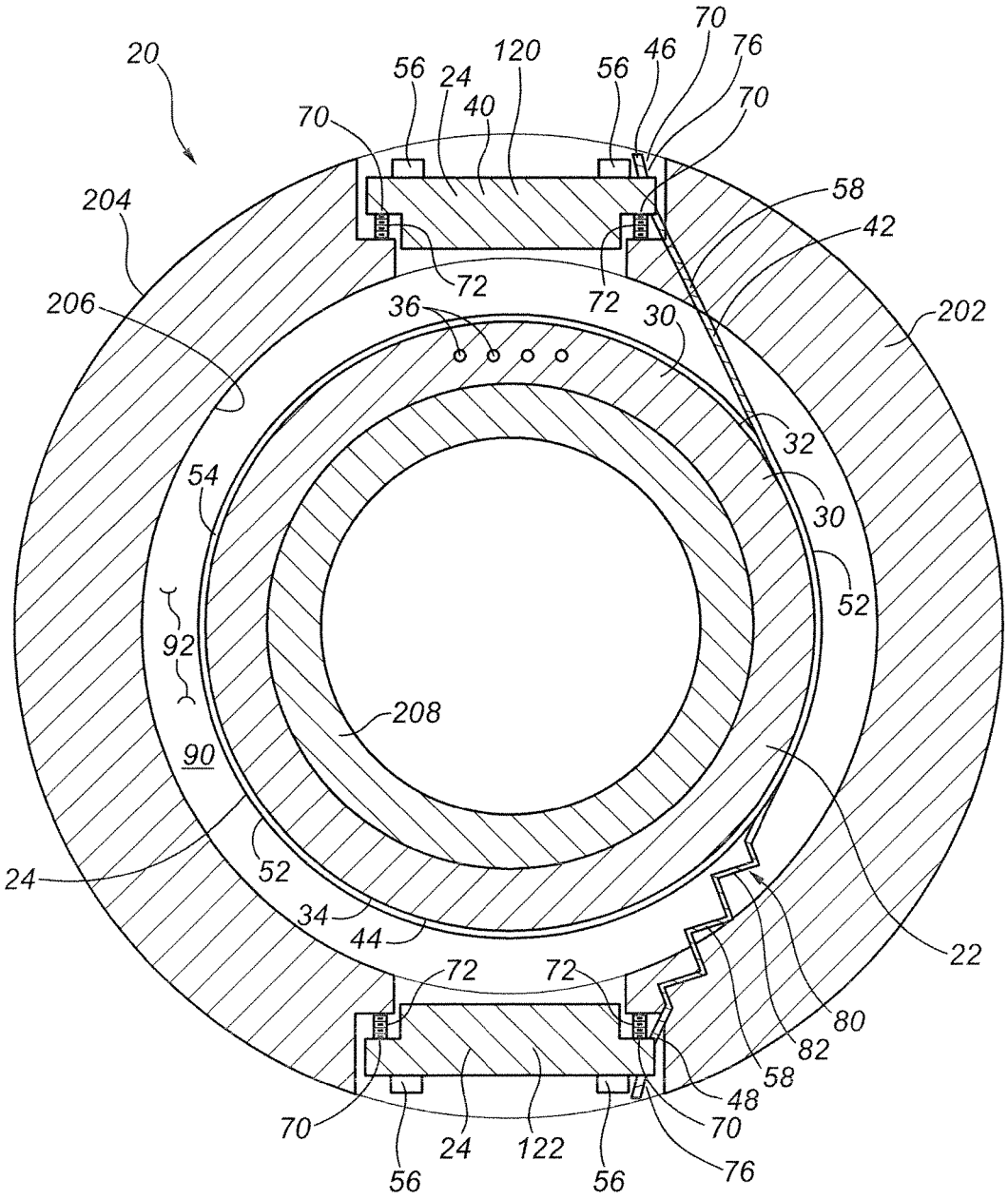
FIG. 2 is a schematic end view of a second exemplary embodiment of a slip ring.
Figure 3:
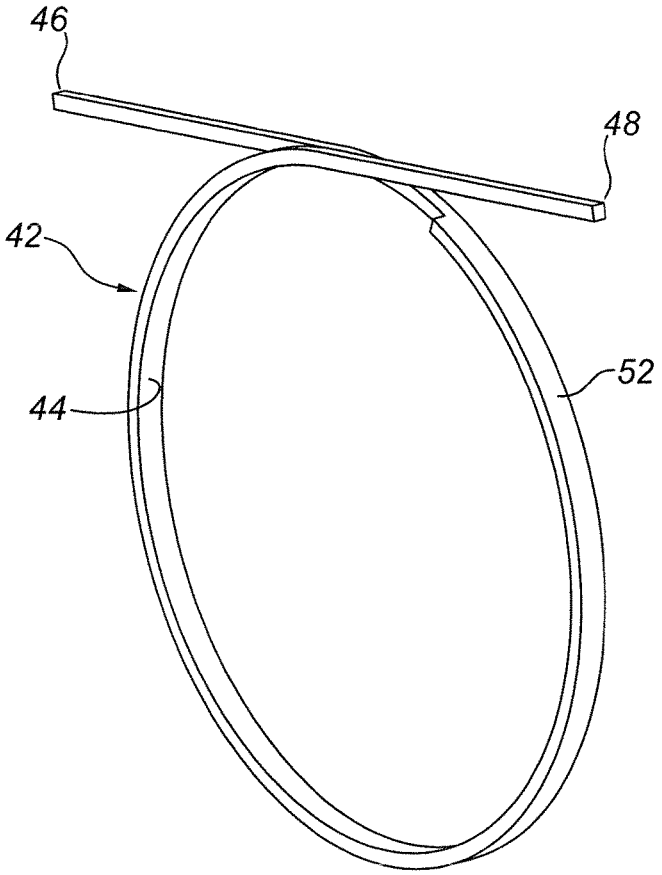
FIG. 3 is a pictorial view of a contact element for use in a third exemplary embodiment of a slip ring.
Figure 4:
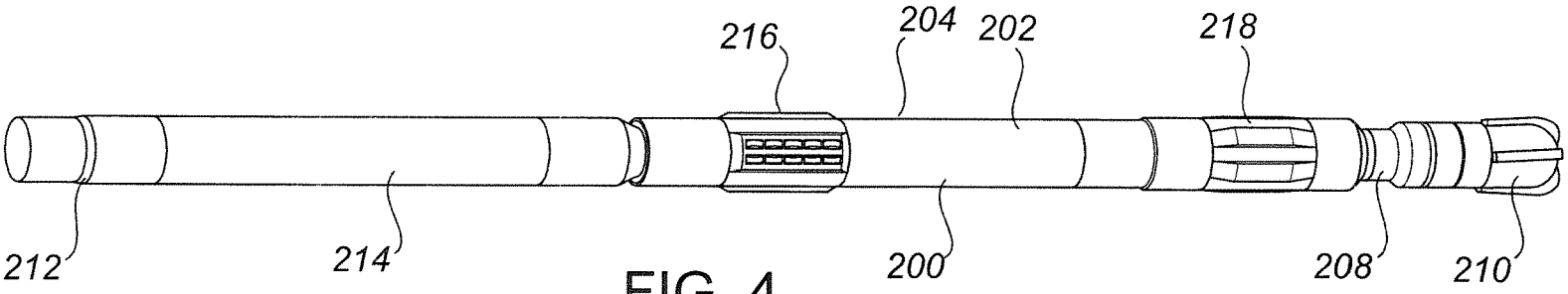
FIG. 4 is a pictorial view of an exemplary rotary steerable drilling apparatus, shown connected with a drill string.
Figure 5:
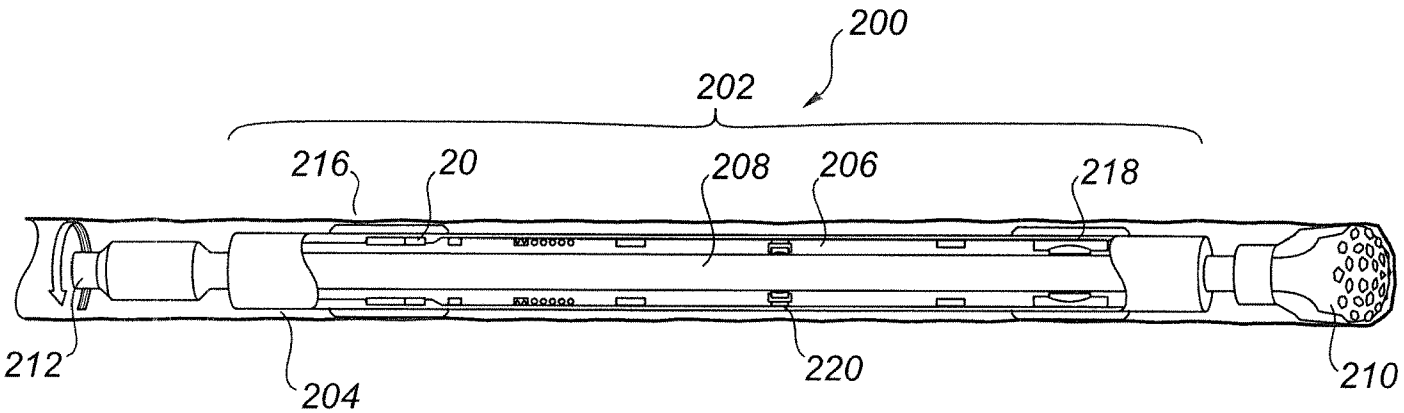
FIG. 5 is a schematic longitudinal section assembly view of the exemplary rotary steerable drilling apparatus depicted in FIG. 4, shown disconnected from the drill string.

FIG. 1 depicts a first exemplary embodiment of a slip ring, in which the slip ring may be provided as a component of an apparatus such as a rotary steerable drilling apparatus. FIG. 2 depicts a second exemplary embodiment of a slip ring, in which the slip ring may be provided as a component of an apparatus such as a rotary steerable drilling apparatus. FIG. 3 depicts a contact element for use in a third exemplary embodiment of a slip ring, in which the slip ring may be provided as a component of an apparatus such as a rotary steerable drilling apparatus. FIGS. 4-5 depict an exemplary rotary steerable drilling apparatus in which the slip ring described in the present disclosure may be used.

Other embodiments of the slip ring may be included in other apparatus within the scope of the present disclosure.

Referring to FIGS. 1-2, a first exemplary embodiment and a second exemplary embodiment respectively of a slip ring (20) are depicted as a component of an exemplary rotary steerable drilling apparatus (200) as depicted in FIGS. 4-5.

Referring to FIG. 3, a contact element for use in a third exemplary embodiment (not shown) of a slip ring (20) is depicted.

As a non-limiting example, the slip ring (20) may be used in a rotary steerable drilling apparatus (200) to replace or supplement an electromagnetic coupling device which may provide a communication link between the housing and the shaft in the rotary steerable drilling apparatus (200).

Referring to FIGS. 1-5, the exemplary rotary steerable drilling apparatus (200) comprises a housing (202) having an exterior (204) and an interior (206). A shaft (208) extends through the interior (206) of the housing (202). The shaft (208) is rotatable relative to the housing (202).

In the exemplary rotary steerable apparatus (200), a drill bit (210) is connected with a distal end of the shaft (208), and a drill string (212) is connected with a proximal end of the shaft (208). The drill string (212) may include a drill string communication system (214) such as a measurement-while-drilling system.

In the exemplary rotary steerable drilling apparatus (200), an anti-rotation device (216) is connected with or integrated into the housing (202) adjacent to a proximal end of the housing (202), and a near-bit stabilizer (218) is connected with or integrated into the housing (202) adjacent to a distal end of the housing (202).

In the exemplary rotary steerable drilling apparatus (200), a deflection mechanism (220) is contained within the housing (202), for deflecting the shaft (208) in order to provide a desired drilling direction.

In the description of the two exemplary embodiments of the slip ring (20) which follows, features which are identical or equivalent in the two exemplary embodiments will be identified with the same reference numbers.

Referring to FIG. 1, the first exemplary embodiment of the slip ring (20) comprises one ring assembly (22) and one contact assembly (24).

In the first exemplary embodiment, the ring assembly (22) is connected with the shaft (208) so that the ring assembly (22) is contained within the interior (206) of the housing (202) and so that the ring assembly (22) is rotatable with the shaft (208) relative to the housing (202). The ring assembly (22) may be connected with the shaft (208) in any suitable manner.

In the first exemplary embodiment, the contact assembly (24) is mounted within the interior (206) of the housing (202) so that the ring assembly (22) is rotatable relative to the contact assembly (24).

In other embodiments, one or more contact assemblies (24) may be connected with the shaft (208) and the ring assembly (22) may be associated with the housing (202) so that the ring assembly (22) is rotatable relative to the one or more contact assemblies (24).

The ring assembly (22) comprises at least one electrically conductive ring (30).

In the first exemplary embodiment, the ring assembly (22) comprises four electrically conductive rings (30) separated by a dielectric material (not shown). In the first exemplary embodiment, the four conductive rings (30) provide four separate electrical channels or paths. In the first exemplary embodiment, the conductive rings (30) are recessed relative to the dielectric material so that the conductive rings (30) provide grooves in the ring assembly (22).

Each of the conductive rings (30) has a conductive ring engagement surface (32). In the first exemplary embodiment, each of the conductive rings (30) has a perimeter (34), and the conductive ring engagement surfaces (32) extend completely around the perimeters (34) of the conductive rings (30) so that the conductive ring engagement surfaces (32) provide uninterrupted conductive paths around the complete perimeters of each of the conductive rings (30).

Referring to FIG. 1, the four conductive rings (30) are electrically connected with four electrical leads (32) which extend axially through the ring assembly (22) and which may be connected with electrical power and/or communication devices (not shown) which may be associated with the shaft (208).

The contact assembly (24) comprises at least one contact block (40) and at least one electrically conductive contact element (42) connected with the at least one contact block (40).

In the first exemplary embodiment, the contact assembly (24) comprises a single contact block (40) and four electrically conductive contact elements (42). In the first exemplary embodiment, each of the four contact elements (42) is connected with the contact block (40). In the first exemplary embodiment, the four contact elements (42) provide four separate electrical channels or paths.

Each of the contact elements (42) has a contact element engagement surface (44), a first contact element end (46), a second contact element end (48), and a contact element length between the first contact element end (46) and the second contact element end (48). In the first exemplary embodiment, the contact elements (42) have a rectangular cross-section with a width which is much greater than the thickness. As a result, in the first exemplary embodiment, the contact elements (42) are shaped generally as a belt, strap or ribbon.

In the first exemplary embodiment, each of the contact elements (42) forms a loop (52) around one of the conductive rings (30). In the first exemplary embodiment, each of the contact element engagement surfaces (44) is engaged with the conductive ring engagement surface (32) of its respective conductive ring (30) along an electrical contact section (54) of the loop (52).

In the first exemplary embodiment, each of the contact element engagement surfaces (44) extends only partially between the first contact element end (46) and the second contact element end (48) along and adjacent to the electrical contact section (54) of the loop (52), thereby providing electrical contact between each contact element (42) and it respective conductive ring (30) while reducing a risk of inadvertent electrical contact between a contact element (42) and components of the rotary steerable drilling apparatus (200).

Referring to FIG. 1, in the first exemplary embodiment, the four contact elements (42) are electrically connected with four electrical leads (56) which extend radially through the contact assembly (24) and which may be connected with electrical power and/or communication devices (not shown) which may be associated with the housing (202). In FIG. 1, only two electrical leads (56) are depicted.

In the first exemplary embodiment, each of the contact elements (42) comprises or is constructed of an electrically conductive material which is covered with an electrically insulating material (58). In the first exemplary embodiment, the contact element engagement surfaces (44) of the contact elements (42) are defined by gaps in the electrically insulating material (58) so that electrical energy can be transferred along the contact element length and between the electrical leads (56) and the contact elements (42).

In the first exemplary embodiment, each of the contact elements (42) is electrically and mechanically connected with the contact block (40). In the first exemplary embodiment, both the first contact element end (46) and the second contact element end (48) of each of the contact elements (42) is connected with the contact block (40). In the first exemplary embodiment, the first contact element end (46) of each of the contact elements (42) is mechanically and/or electrically connected with the contact block (40). In the first exemplary embodiment, the second contact element end (48) of each of the contact elements (42) is mechanically and/or electrically connected with the contact block (40).

The slip ring (20) may comprise one or more tensioning mechanisms (70) for tensioning the contact elements (42) against the conductive ring engagement surfaces (32) of their respective conductive rings (30).

In the first exemplary embodiment, a tensioning mechanism (70) may comprise a device for adjusting the distance between the contact block (40) and the conductive rings (30). In the first exemplary embodiment, the device for adjusting the distance between the contact block (40) and the conductive rings (30) may comprise one or more adjustable screws (72) carried by the contact block (40), which may be advanced or retracted to adjust the position of the contact block (40) within the housing (202).

In the first exemplary embodiment, a tensioning mechanism (70) may additionally or alternatively comprise a device for adjusting the loop length of a loop (52) formed by a contact element (42). In the first exemplary embodiment, the device for adjusting the loop length of a loop (52) formed by a contact element (42) may comprise a contact element clamp (76) carried by the contact block (40), which may be loosened to adjust the loop length of the contact element (42) and which may be tightened to maintain a desired loop length of the contact element (42). In the first exemplary embodiment, a separate contact element clamp (76) may be provided for each contact element (42).

The slip ring (20) may comprise one or more biasing mechanisms (80) for urging the contact elements (42) against the conductive ring engagement surfaces (32) of their respective conductive rings (30).

In the first exemplary embodiment, a biasing mechanism (80) may comprise a spring (82). In the first exemplary embodiment, a spring (82) may be provided for each contact element (42). In the first exemplary embodiment, the springs (82) are integral with the contact elements (42) so that the contact elements (42) are comprised of the springs (82).

In the first exemplary embodiment, the slip ring (20) is further comprised of a dielectric fluid chamber (90) which surrounds the ring assembly (22) and the contact assembly (24). In the first exemplary embodiment, the dielectric fluid chamber (90) is defined within the rotary steerable drilling apparatus (200). A dielectric fluid (92) is contained in the dielectric fluid chamber (90) so that the ring assembly (22) and the contact assembly (24) are immersed in the dielectric fluid (92).

In the first exemplary embodiment, the contact block (40) is located adjacent to each of the conductive rings (30) on a contact block side (100) of the conductive rings (30). In the first exemplary embodiment, the loops (52) formed by the contact elements (42) and the electrical contact sections (54) of the loops (52) do not extend fully around the conductive rings (30). As a result, in the first exemplary embodiment, electrical contact sides (102) of the conductive rings (30) are defined by the electrical contact sections (54) of the loops (52). In the first exemplary embodiment, the electrical contact sides (102) of the conductive rings (30) are opposite to the contact block sides (100) of the conductive rings (30), so that the conductive rings (30) are interposed between the contact block (40) and the electrical contact sections (54) of the loops (52).

The description of the second exemplary embodiment of the slip ring (20) which follows is limited primarily to the differences between the second exemplary embodiment and the first exemplary embodiment.

Referring to FIG. 2, the second exemplary embodiment of the slip ring (20) comprises one ring assembly (22) and one contact assembly (24).

In the second exemplary embodiment, the ring assembly (22) comprises four electrically conductive rings (30) separated by a dielectric material (not shown). In the second exemplary embodiment, the four conductive rings (30) provide four separate electrical channels or paths.

In the second exemplary embodiment, the contact assembly (24) comprises a first contact block (120) as the contact block (40), a second contact block (122), and four electrically conductive contact elements (42). In the second exemplary embodiment, each of the four contact elements (42) is connected with both the first contact block (120) and the second contact block (122). In the second exemplary embodiment, the four contact elements (42) provide four separate electrical channels or paths.

In the second exemplary embodiment, the first contact element ends (46) of the contact elements (42) are connected with the first contact block (120) and the second contact element ends (48) of the contact elements (42) are connected with the second contact block (122). In the second exemplary embodiment, the first contact element ends (46) of each of the contact elements (42) are mechanically and/or electrically connected with the first contact block (120). In the second exemplary embodiment, the second contact element ends (48) of each of the contact elements (42) are mechanically and/or electrically connected with the second contact block (122).

In the second exemplary embodiment, the loops (52) formed by the contact elements (42) and the electrical contact sections (54) of the loops (52) extend more than one full turn around their respective conductive rings (30). As a result, in the second exemplary embodiment, the electrical contact sections (54) of the loops (52) generally surround the conductive rings (30).

In the second exemplary embodiment, the conductive rings (30) and the contact elements (42) are configured to accommodate the extension of the loops (52) more than one full turn around the conductive rings (30). More specifically, in the second exemplary embodiment, the width of the conductive rings (30) and/or the conductive ring engagement surfaces (44) is greater than the width of the contact elements (42) and/or the contact element engagement surfaces (44). In the second exemplary embodiment, the contact elements (42) have a circular cross-section and are shaped generally as a cable or a wire.

In the second exemplary embodiment, adjustable screws (72) are carried by both the first contact block (120) and the second contact block (122) to provide a tensioning mechanism (70)

In the second exemplary embodiment, contact element clamps (76) are additionally or alternatively carried by both the first contact block (120) and the second contact block (122) to provide a tensioning mechanism (70).

In the second exemplary embodiment, springs (82) are integral with each contact element (42) to provide a biasing mechanism (80).

In the second exemplary embodiment, the first contact block (120) and the second contact block (122) are located adjacent to the conductive rings (30) and are separated from each other around the circumference of the conductive rings (30). In the second exemplary embodiment, since the loops (52) formed by the contact elements (42) and the electrical contact sections (54) of the loops (52) extend more than one full turn around the conductive rings (30), the electrical contact sections (54) generally surround the conductive rings (30).

Referring to FIG. 3, the exemplary embodiment of a contact element (42) for use in a third exemplary embodiment (not shown) of the slip ring (20) is configured to extend substantially one full turn or more than one full turn around a conductive ring (30).

To accommodate overlapping of the contact element (42) adjacent the ends (46, 48) of the contact element (42) and thereby enable the contact element (42) to extend substantially one full turn or more than one full turn around a conductive ring (30), the contact element (42) has a reduced width adjacent to each of the first contact element end (46) and the second contact element end (48).

The contact assembly (24) of the third exemplary embodiment of the slip ring (20) may comprise a contact block (40) which is similar to the contact block (40) of the first exemplary embodiment.

The third exemplary embodiment of the slip ring (20) may comprise any number of contact elements (42) and corresponding electrically conductive rings (30). As a non-limiting example, the third exemplary embodiment of the slip ring (20) may comprise four conductive rings (30) and four contact elements (42), as in the first exemplary embodiment and the second exemplary embodiment.

A first exemplary method, for assembling the first exemplary embodiment of the slip ring (20), may comprise the following:

(a) providing the ring assembly (22) and the contact assembly (24);

(b) extending a contact element (42) around a conductive ring (30) so that the contact element (42) forms a loop (52) around the conductive ring between the first contact element end (46) and the second contact element end (48) and so that the contact element engagement surface (44) is engaged with the conductive ring engagement surface (32); and (c) connecting the first contact element end (46) and the second contact element end (48) with the contact block (40).

The first exemplary method may be further comprised of tensioning the contact element (42) against the conductive ring engagement surface (32). The tensioning may comprise adjusting the distance between the contact block (40) and the conductive ring (30) using adjusting screws (72) which are carried by the contact block (40) as a tensioning mechanism (70), and/or adjusting the loop length of the loop (52) using contact element clamps (76) which are carried by the contact block (40) as a tensioning mechanism (70).

The first exemplary method may be further comprised of urging the contact element (42) against the conductive ring engagement surface (32). The urging may comprise providing a spring (82) as a biasing mechanism (80).

The first exemplary method may be further comprised of immersing the slip ring (20) in a dielectric fluid (92).

A second exemplary method, for assembling the second exemplary embodiment of the slip ring (20), may comprise the following:

(a) providing the ring assembly (22) and the contact assembly (24);

(b) extending a contact element (42) around a conductive ring (30) so that the contact element (42) forms a loop (52) around the conductive ring between the first contact element end (46) and the second contact element end (48) and so that the contact element engagement surface (44) is engaged with the conductive ring engagement surface (32); and (c) connecting the first contact element end (46) with the first contact block (120) and connecting the second contact element end (48) with the second contact block (122).

The second exemplary method may be further comprised of tensioning the contact element (42) against the conductive ring engagement surface (32). The tensioning may comprise adjusting the distance between the first contact block (120) and the conductive ring (30) and/or the second contact block (122) and the conductive ring (30) using adjusting screws (72) which are carried by the contact blocks (120, 122) as a tensioning mechanism (70), and/or adjusting the loop length of the loop (52) using contact element clamps (76) which are carried by the first contact block (120) and/or the second contact block (122) as a tensioning mechanism (70).

The second exemplary method may be further comprised of urging the contact element (42) against the conductive ring engagement surface (32). The urging may comprise providing a spring (82) as a biasing mechanism (80).

The second exemplary method may be further comprised of immersing the slip ring (20) in a dielectric fluid (92).

As described herein, the slip ring (20) described in this disclosure facilitates the use of tension to maintain contact between a contact element (42) and a conductive ring (30), and facilitates the ability to provide a desired amount of tension to accommodate the requirements of the slip ring (20).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

I claim:

1. A slip ring comprising:

(a) a ring assembly, wherein the ring assembly comprises an electrically conductive ring, wherein the conductive ring has a perimeter, and wherein the conductive ring comprises a conductive ring engagement surface extending around the perimeter of the conductive ring; and (b) a contact assembly, wherein the contact assembly comprises:

(i) a contact block; and (ii) a contact element, wherein the contact element comprises a first contact element end, a second contact element end, and an electrically conductive contact element engagement surface, wherein both the first contact element end and the second contact element end are connected with the contact block, wherein the contact element forms a loop around the conductive ring between the first contact element end and the second contact element end, wherein the loop has a loop length, and wherein the contact element engagement surface is engaged with the conductive ring engagement surface along an electrical contact section of the loop;

(c) a biasing mechanism for urging the contact element against the conductive ring engagement surface; and (d) a tensioning mechanism for tensioning the contact element against the conductive ring engagement surface, wherein the tensioning mechanism comprises at least one of a device comprising one or more adjustable screws carried by the contact block for adjusting a distance between the contact block and the conductive ring, and a device comprising a contact element clamp carried by the contact block for adjusting the loop length of the contact element.

2. The slip ring as claimed in claim 1 wherein the contact block is located adjacent to the conductive ring on a contact block side of the conductive ring, wherein the electrical contact section of the loop is on an electrical contact side of the conductive ring, and wherein the electrical contact side of the conductive ring is opposite to the contact block side of the conductive ring.

3. The slip ring as claimed in claim 1 wherein the biasing mechanism comprises a spring.

4. The slip ring as claimed in claim 3 wherein the spring is integral with the contact element so that the contact element comprises the spring.

5. The slip ring as claimed in claim 1 wherein the ring assembly comprises a plurality of conductive rings, wherein each of the conductive rings comprises the conductive ring engagement surface, wherein the contact assembly comprises a plurality of contact elements for engaging with the plurality of conductive rings, wherein each of the contact elements comprises a first contact element end, a second contact element end, and a contact element engagement surface for engaging with one of the conductive ring engagement surfaces, wherein both the first contact element end and the second contact element end of at least one of the contact elements are connected with the contact block, and wherein each of the contact elements forms a loop around its respective conductive ring engagement surface between the first contact element end and the second contact element end, wherein the slip ring comprises one or more of the biasing mechanisms for urging at least one of the contact elements against its respective conductive ring engagement surface, and wherein the slip ring comprises one or more of the tensioning mechanisms for tensioning at least one of the contact elements against its respective conductive ring engagement surface.

6. The slip ring as claimed in claim 1 wherein the slip ring is immersed in a dielectric fluid.

7. The slip ring as claimed in claim 1 wherein the slip ring is a component of an apparatus comprising a housing having an interior and a shaft rotatably extending through the interior of the housing, and wherein the slip ring transfers electrical energy between the housing and the shaft.

8. The slip ring as claimed in claim 7 wherein the apparatus is an apparatus for use in drilling a borehole.

9. The slip ring as claimed in claim 7 wherein the apparatus is a rotary steerable drilling apparatus for use in drilling a borehole.

10. A method for assembling a slip ring comprising a ring assembly and a contact assembly, the method comprising:

(a) providing the ring assembly, wherein the ring assembly comprises an electrically conductive ring, wherein the conductive ring has a perimeter, and wherein the conductive ring comprises a conductive ring engagement surface extending around the perimeter of the conductive ring;

(b) providing the contact assembly, wherein the contact assembly comprises a contact block and a contact element, wherein the contact element comprises a first contact element end, a second contact element end, and an electrically conductive contact element engagement surface;

(c) extending the contact element around the conductive ring so that the contact element forms a loop around the conductive ring between the first contact element end and the second contact element end and so that the contact element engagement surface is engaged with the conductive ring engagement surface along an electrical contact section of the loop, wherein the loop has a loop length;

(d) connecting both the first contact element end and the second contact element end with the contact block;

(e) tensioning the contact element against the conductive ring engagement surface, wherein tensioning comprises at least one of adjusting a distance between the contact block and the conductive ring using a device comprising one or more adjustable screws carried by the contact block, and adjusting the loop length of the contact element using a device comprising a contact block clamp carried by the contact block; and (f) urging the contact element against the conductive ring engagement surface with a biasing mechanism.

11. The method as claimed in claim 10 wherein the contact block is located adjacent to the conductive ring on a contact block side of the conductive ring, wherein the electrical contact section of the loop is on an electrical contact side of the conductive ring, and wherein the electrical contact side of the conductive ring is opposite to the contact block side of the conductive ring.

12. The method as claimed in claim 10, further comprising immersing the slip ring in a dielectric fluid.

13. The method as claimed in claim 10 wherein the biasing mechanism comprises a spring.

14. The method as claimed in claim 13 wherein the spring is integral with the contact element so that the contact element comprises the spring.

15. A slip ring comprising:

(a) a ring assembly, wherein the ring assembly comprises an electrically conductive ring, wherein the conductive ring has a perimeter, and wherein the conductive ring comprises a conductive ring engagement surface extending around the perimeter of the conductive ring; and (b) a contact assembly, wherein the contact assembly comprises:

(i) a first contact block;

(ii) a second contact block;

(iii) a contact element, wherein the contact element comprises a first contact element end, a second contact element end, and an electrically conductive contact element engagement surface, wherein the first contact element end is connected with the first contact block, wherein the second contact element end is connected with the second contact block, wherein the contact element forms a loop around the conductive ring between the first contact element end and the second contact element end, wherein the loop has a loop length, and wherein the contact element engagement surface is engaged with the conductive ring engagement surface along an electrical contact section of the loop;

(c) a biasing mechanism for urging the contact element against the conductive ring engagement surface; and (d) a tensioning mechanism for tensioning the contact element against the conductive ring engagement surface, wherein the tensioning mechanism comprises at least one of a device comprising one or more adjustable screws carried by the first contact block for adjusting a distance between the first contact block and the conductive ring, a device comprising a contact element clamp carried by the first contact block for adjusting the loop length of the contact element, a device comprising one or more adjustable screws carried by the second contact block for adjusting a distance between the second contact block and the conductive ring, and a device comprising a contact element clamp carried by the second contact block for adjusting the loop length of the contact element.

16. The slip ring as claimed in claim 15 wherein the biasing mechanism comprises a spring.

17. The slip ring as claimed in claim 16 wherein the spring is integral with the contact element so that the contact element comprises the spring.

18. The slip ring as claimed in claim 15 wherein the ring assembly comprises a plurality of conductive rings, wherein each of the conductive rings comprises the conductive ring engagement surface, wherein the contact assembly comprises a plurality of contact elements for engaging with the plurality of conductive rings, wherein each of the contact elements comprises a first contact element end, a second contact element end, and a contact element engagement surface for engaging with one of the conductive ring engagement surfaces, wherein the first contact element end of at least one of the contact elements is connected with the first contact block, wherein the second contact element end of the at least one of the contact elements is connected with the second contact block, and wherein each of the contact elements forms a loop around its respective conductive ring engagement surface between the first contact element end and the second contact element end, wherein the slip ring comprises one or more of the biasing mechanisms for urging at least one of the contact elements against its respective conductive ring engagement surface, and wherein the slip ring comprises one or more of the tensioning mechanisms for tensioning at least one of the contact elements against its respective conductive ring engagement surface.

19. The slip ring as claimed in claim 15 wherein the slip ring is immersed in a dielectric fluid.

20. The slip ring as claimed in claim 15 wherein the slip ring is a component of an apparatus comprising a housing having an interior and a shaft rotatably extending through the interior of the housing, and wherein the slip ring transfers electrical energy between the housing and the shaft.

21. The slip ring as claimed in claim 20 wherein the apparatus is an apparatus for use in drilling a borehole.

22. The slip ring as claimed in claim 20 wherein the apparatus is a rotary steerable drilling apparatus for use in drilling a borehole.

23. A method for assembling a slip ring comprising a ring assembly and a contact assembly, the method comprising:

(a) providing the ring assembly, wherein the ring assembly comprises an electrically conductive ring, wherein the conductive ring has a perimeter, and wherein the conductive ring comprises a conductive ring engagement surface extending around the perimeter of the conductive ring;

(b) providing the contact assembly, wherein the contact assembly comprises a first contact block, a second contact block, and a contact element, wherein the contact element comprises a first contact element end, a second contact element end, and an electrically conductive contact element engagement surface;

(c) extending the contact element around the conductive ring so that the contact element forms a loop around the conductive ring between the first contact element end and the second contact element end and so that the contact element engagement surface is engaged with the conductive ring engagement surface along an electrical contact section of the loop, wherein the loop has a loop length;

(d) connecting the first contact element end with the first contact block and connecting the second contact element end with the second contact block;

(e) tensioning the contact element against the conductive ring engagement surface, wherein tensioning comprises at least one of adjusting a distance between the first contact block and the conductive ring using a device comprising one or more adjustable screws carried by the first contact block, adjusting the loop length of the contact element using a device comprising a contact block clamp carried by the first contact block, adjusting a distance between the second contact block and the conductive ring using a device comprising one or more adjustable screws carried by the second contact block, and adjusting the loop length of the contact element using a device comprising a contact block clamp carried by the second contact block; and (f) urging the contact element against the conductive ring engagement surface with a biasing mechanism.

24. The method as claimed in claim 23, further comprising immersing the slip ring in a dielectric fluid.

25. The method as claimed in claim 23 wherein the biasing mechanism comprises a spring.

26. The method as claimed in claim 25 wherein the spring is integral with the contact element so that the contact element comprises the spring.

* * * * *